US006634727B2

(12) United States Patent
Torres

(10) Patent No.: US 6,634,727 B2
(45) Date of Patent: Oct. 21, 2003

(54) CLOSET DOORS WITH INTEGRATED SHELVES

(76) Inventor: Frank Torres, 11550 Elm Ct., Thornton, CO (US) 80233

( * ) Notice: Subject to any disclaimer, the term of this patent is extended or adjusted under 35 U.S.C. 154(b) by 0 days.

(21) Appl. No.: 09/946,184

(22) Filed: Sep. 4, 2001

(65) Prior Publication Data

US 2003/0042829 A1 Mar. 6, 2003

(51) Int. Cl.[7] ..... E06B 1/00
(52) U.S. Cl. ..... 312/321.5; 312/324; 49/390
(58) Field of Search ..... 312/204, 321.5, 312/202, 201, 324, 310, 248; 52/37; 49/381, 504, 390, 402

(56) References Cited

U.S. PATENT DOCUMENTS 2,694,232 A * 11/1954 Wolfe ..... 160/199
3,053,602 A * 9/1962 Golenpaul ..... 312/201
4,219,248 A * 8/1980 Goldberg ..... 108/142
5,795,043 A * 8/1998 Johnson et al. ..... 312/229
6,402,271 B1 * 6/2002 Kelley et al. ..... 312/196
6,457,278 B1 * 10/2002 Fleming ..... 52/37

OTHER PUBLICATIONS

Space X Doors—Brochure (undated).
Printout from http://www.spacexdoors.com.Products. HTM (5 pages) (©2000).

* cited by examiner

*Primary Examiner*—Lanna Mai
*Assistant Examiner*—Jerry A. Anderson
(74) *Attorney, Agent, or Firm*—Merchant & Gould P.C.

(57) ABSTRACT

A closet door assembly includes at least one closet door having a back panel, an outer side panel, an inner side panel, a top panel, and a bottom panel connected to the back panel forming an interior space. At least one shelf is positioned within the interior space of the closet door. A top frame is attached to a top of a closet doorway. Each closet door is pivotally connected to the top frame with an upper hinge assembly and pivotally connected to the floor surface of the doorway with a lower hinge assembly. The hinge assemblies are attached near the outer side panel of each door thereby permitting the inner side panel of each door to pivot between a closed position within the doorway and an open position away from the doorway.

18 Claims, 11 Drawing Sheets

CLOSET DOORS WITH INTEGRATED SHELVES

BACKGROUND OF THE INVENTION

The present invention relates to closet doors, and more particularly concerns closet doors with integrated shelves for saving space and concealing the entrance to and the existence of closets.

Generally, closet doors serve the purpose of concealing the interior of closets and other storage spaces. However, conventional closet doors are unsightly and often waste space. One way to minimize this wasted space is to use sliding closet doors or bifold closet doors, as opposed to swing doors, which provide more free floor space directly outside the closet door. However, while these doors may save exterior floor space and conceal the interior of a closet, they do not conceal the existence of the closet itself.

Another way to save space is to incorporate a storage function into a closet door in order to provide additional storage space. For example, closet doors may have integrated bookshelves thereby providing storage space for books or other items while also serving the function of closing off and concealing closets or storage space. However, conventional closet doors with integrated bookshelves contain bi-fold doors that are cumbersome, heavy, and require a bulky track set into both the floor and the top of the door opening. Further, bi-fold closet doors are difficult and time consuming to install due to the heavy horizontal-tracks and roller mechanisms that run along these tracks. An additional problem with the bi-fold doors is that they require a minimum width for proper operation, i.e., they cannot be used for closet doorways smaller than a certain width, such as for single door or other narrow doorways.

Accordingly, a closet door with integrated shelves solving the aforementioned and other problems is desired.

SUMMARY OF THE INVENTION

Against this backdrop the present invention has been developed to solve the above and other problems by using a A closet door assembly includes one or two closet doors, each having a back panel, an outer side panel, an inner side panel, a top panel, and a bottom panel connected to the back panel forming an interior space. At least one shelf and preferably many shelves are positioned within the interior space of the closet doors to make the doors appear to be bookcases and conceal the closet doorway. A top frame is attached to a top of a closet doorway further helping to conceal the closet doorway. Each of the closet doors is pivotally connected to the top frame with an upper hinge assembly and pivotally connected to the floor surface of the doorway with a lower hinge assembly. The hinge assemblies are attached near the outer side panel of each door thereby permitting the inner side panel of the doors to pivot away from a closed position within the doorway to an open position away from the doorway. A latch assembly is used to keep the closet doors in a closed position.

These and various other features as well as advantages which characterize the present invention will be apparent from a reading of the following detailed description and a review of the associated drawings.

DETAILED DESCRIPTION

Figure 1:
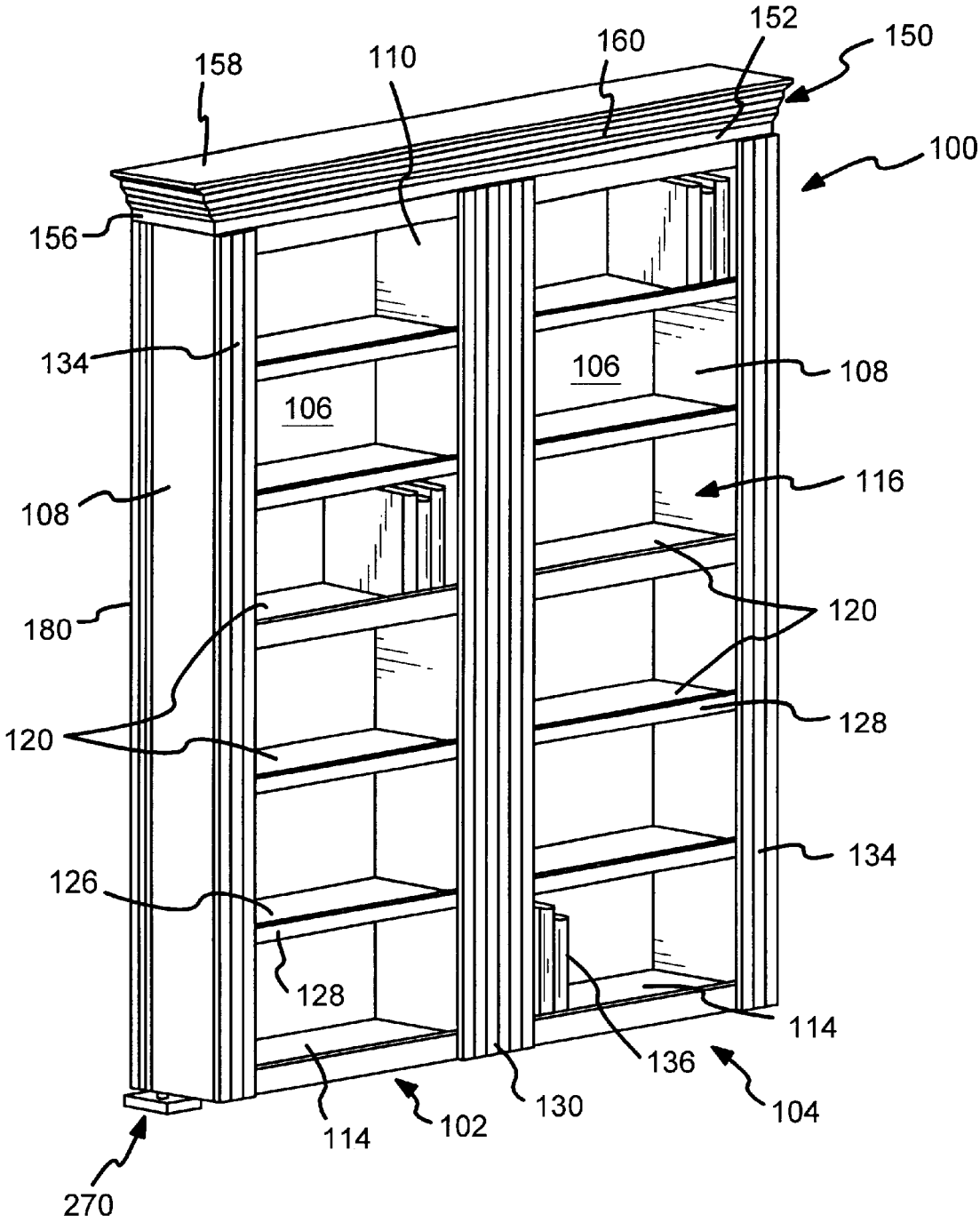
FIG. 1 shows a perspective view of a preferred embodiment of the present invention showing two closet doors in a closed position.
Figure 2:
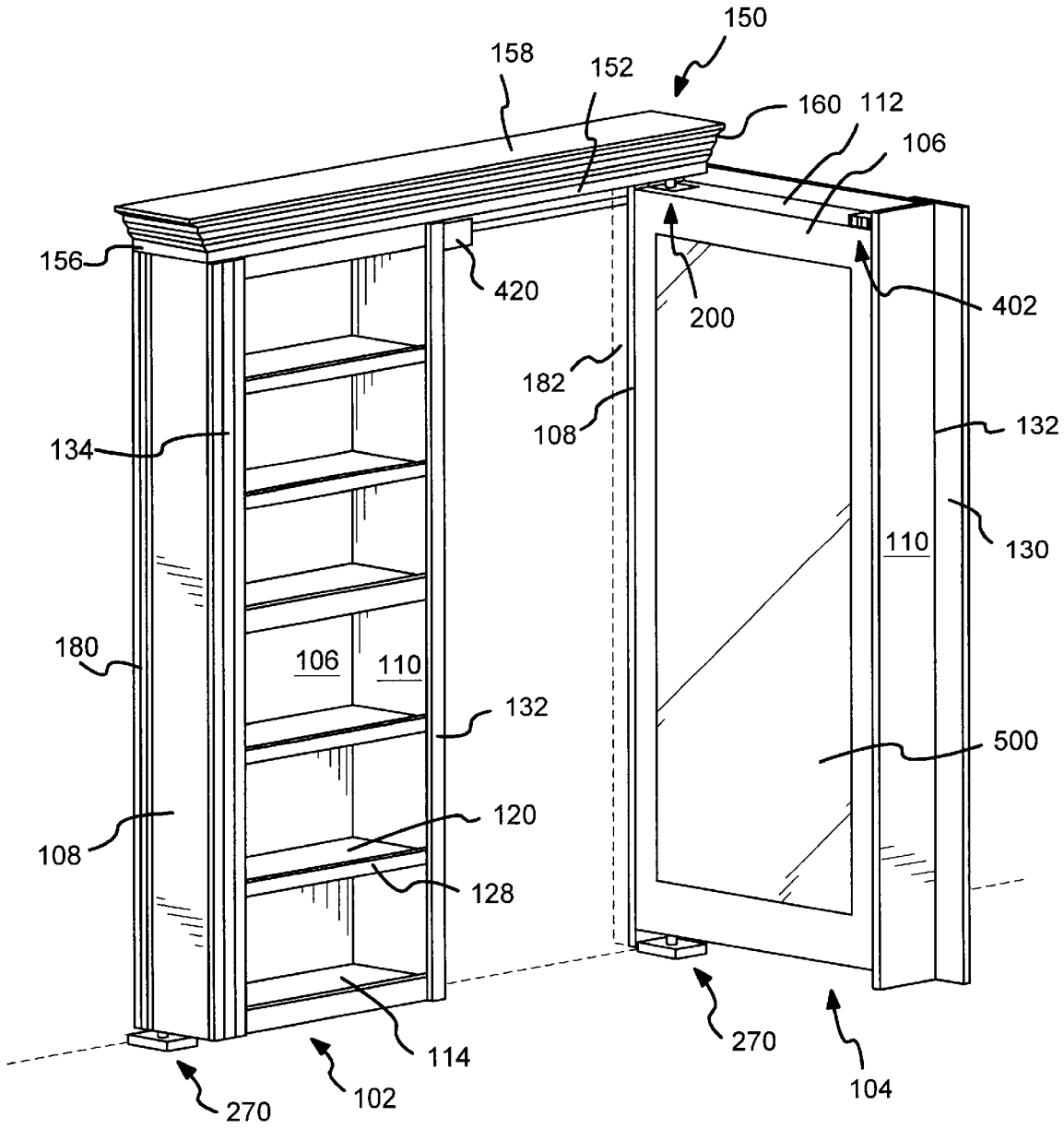
FIG. 2 shows a perspective view of the closet doors from FIG. 1 with one closet door in an open position and one door in a closed position.
Figure 3:
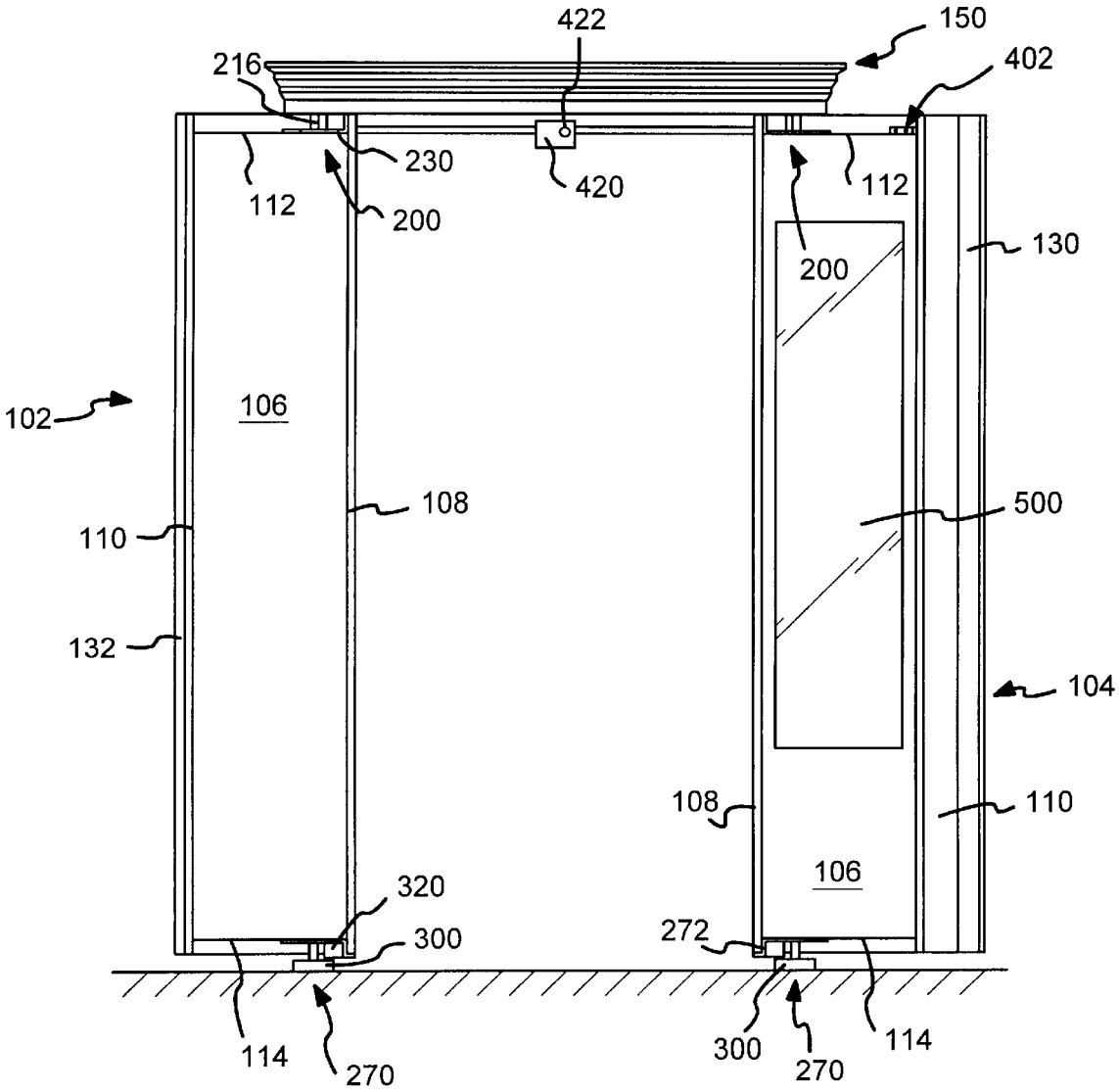
FIG. 3 shows a front plan view of the closet doors from FIG. 1 with both closet doors in an open position.

FIGS. 1–3 show a preferred embodiment of the present invention comprising a closet door assembly 100 having a first door 104, a second door 102, one or more shelves 120, two upper hinge assemblies 200, two lower hinge assemblies 270, and a latch assembly 400.

As shown in FIG. 1, each of the closet doors 102 and 104 have a back panel 106, an outer side panel 108, and inner side panel 110, a top panel 112 (shown in FIG. 2), and a bottom panel 114. The back panel 106 is connected to the top panel 112, the bottom panel 114, and both side panels 108 and 110 forming a rectangular-shaped interior 116 that opens to the front of the doors 102 and 104. One or more shelves 120 are attached within the interior 116 of the doors 102 and 104. Each shelf 120 has a vertical lip 128 attached to a front edge 126 of the shelf 120; the lip 128 extends above an upper surface of the shelf 120 to prevent movement of items stored on the shelves, such as books 136, when the doors 102 or 104 are moved between open and closed positions. Additionally, as best seen in FIG. 2, the door 104 may include a vertical piece of molding 130 attached along a front edge 132 of the inner side panel 110 and extending past the front edge 132 on each side to conceal a joinder of the inner side panels 110 of the doors 102 and 104 when both in a closed position as shown in FIG. 1. Additional pieces of molding 134 are preferably attached to front edges 132 of the outer side panels 108 to match the center molding 130 and further conceal the purpose of the doors 102 and 104.

The closet door assembly 100 preferably includes a top frame 150 attached to the top of a doorway as shown in FIG. 3 and extending at least the full width of the doorway. The top frame 150 provides an upper support for the doors 102 and 104 (as described below) and includes a front panel 152, a back panel 154, two side panels 156 and a top panel 158. The top panel 158 connects to the side panels 156 and the front and back panels 152 and 154 to form a rectangular interior 162 (FIG. 4) opening towards the floor. A cornice 160 is preferably attached to outer surfaces of the front and side panels 152 and 156 to help conceal the doorway.

The closet door assembly 100 may additionally include side frames 180 attached to outer side edges 182 of the doorway. The side frames 180 help conceal the doorway and may also provide an outer stop for the doors 102 and 104 when open.

Figure 4:
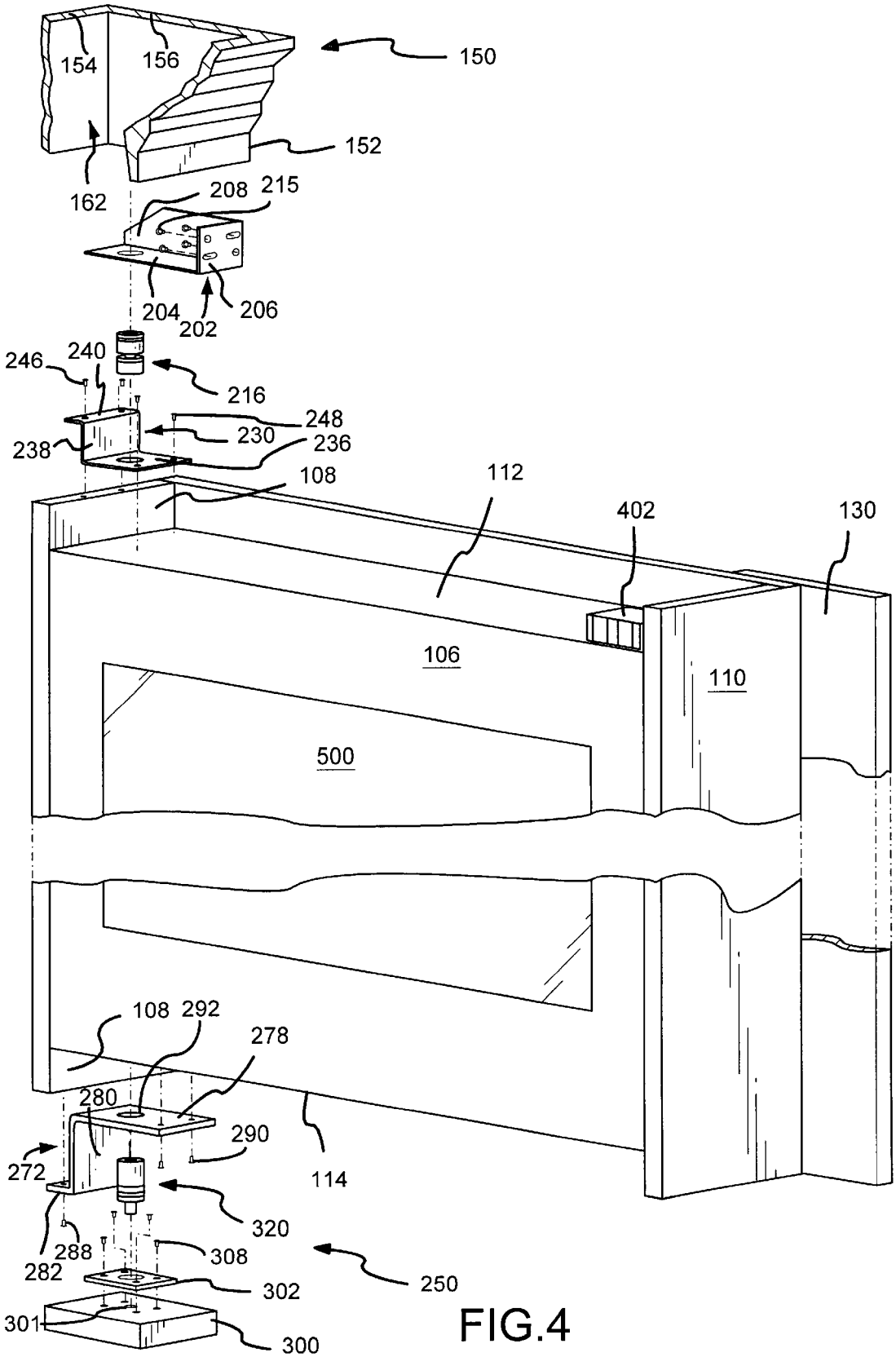
FIG. 4 shows a partial exploded view of one of the closet doors from FIG. 1 with portions cut away for clarity.

As shown in FIGS. 2–4, each of the doors 102 and 104 pivot about an upper hinge assembly 200 and a lower hinge assembly 270. The upper hinge assembly 200 connects the doors 102 and 104 to the top frame 150, while the lower hinge assembly 270 is preferably mounted to the floor.

Figure 5:
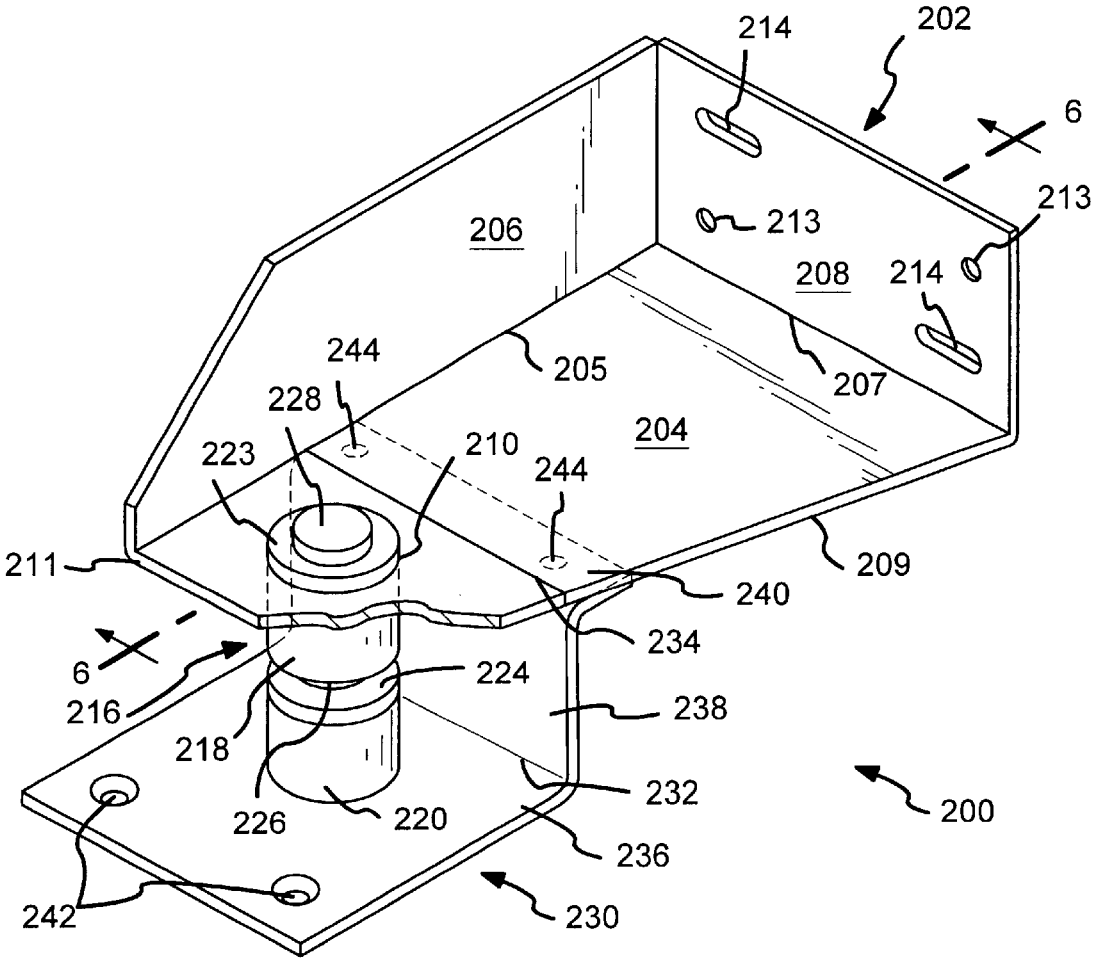
FIG. 5 shows a perspective view of a bottom hinge assembly that supports the closet doors shown in FIG. 1.
Figure 6:
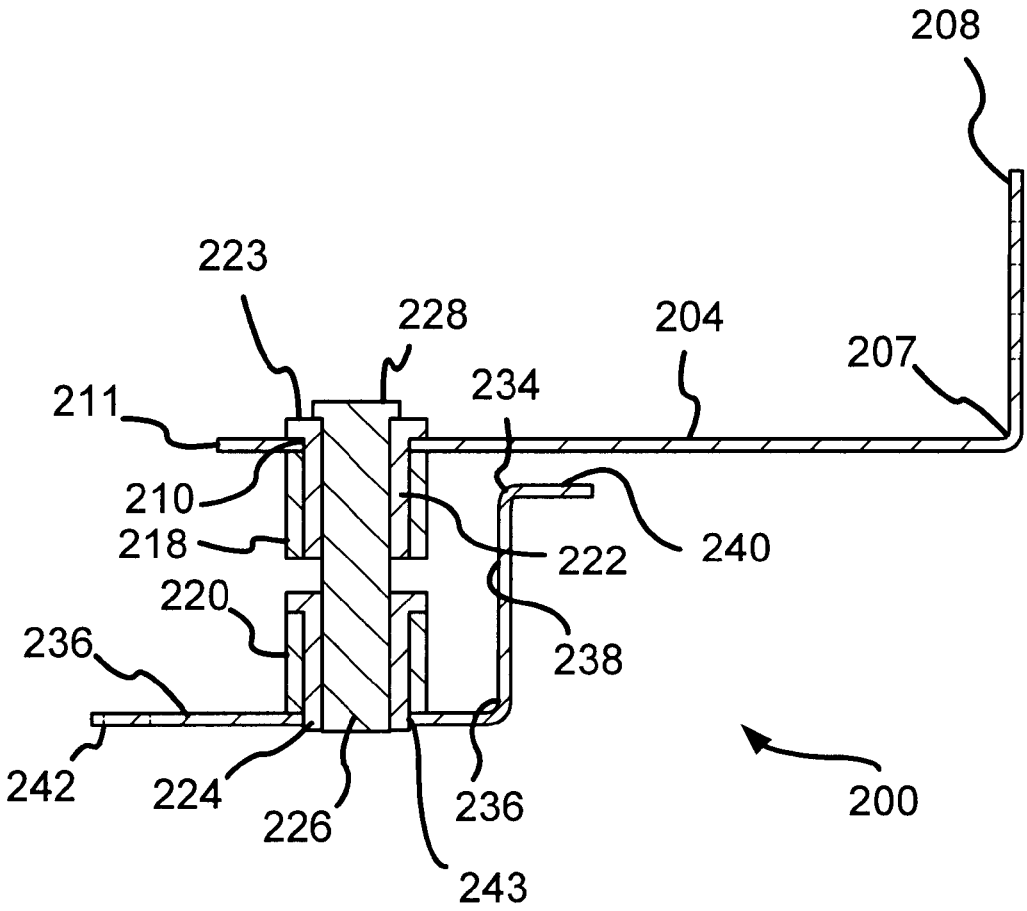
FIG. 6 is a sectional view through lines 6—6 of FIG. 5.

As best seen in FIGS. 5 and 6, the upper hinge assembly 200 has a frame bracket 202 and an upper door bracket 230 pivotally connected to a pin assembly 216. The frame bracket 202 has a base 204 with four edges 205, 207, 209, and 211 wherein the edges 205 and 207 form a right angle. A front wall 206 is connected to the edge 205 and a side wall 208 is connected to the edge 207 such that the walls 206 and 208 are positioned in a perpendicular plane to each other. The base 204 has a pin aperture 210 positioned near the edge 211. The front wall 206 includes one or more mounting apertures which may be round such as aperture 213 or elongated, such as aperture 214. As shown in FIG. 4, the front wall 206 of the frame bracket 202 preferably is mounted to an inner surface of the front panel 152 of the top frame 150 via fasteners 215, such as screws, and is positioned such that the side wall 208 is generally adjacent to an inner surface of the side panel 156.

The door bracket 230 is made from a single sheet of metal having two bends 232 and 234 to form a generally S-shaped bracket having an elongated bottom portion 236, a vertical middle portion 238, and a relatively short top portion 240. The elongated bottom portion 236 includes two mounting apertures 242 positioned generally opposite the first bend 232 and a pin aperture 243 located generally in its center. The top portion 240 also includes two mounting apertures 244 positioned generally opposite the second bend 234. The door bracket 230 is mounted to each of the doors 102 and 104 as shown in FIG. 4. Specifically, the top portion 240 is mounted via screws 246 through mounting apertures 244 to an upper edge of the outer side panel 108 so that the vertical middle portion 238 rests along an inner surface of the outer side panel 108. The elongated bottom portion 236 is mounted via screws 248 through the mounting apertures 242 to an upper surface of the top panel 112.

The pin assembly 216 (shown in FIGS. 5 and 6) includes an upper collar 218 fixed about the pin aperture 210 formed in the frame bracket 202, and a lower collar 220 fixed about the pin aperture 243 formed in the door bracket 230. An upper sleeve 222 having a rim 223 fits within the upper collar 218 such that the rim 223 rests on an upper surface of the base 204 of the frame bracket 202. A lower sleeve 224 fits within the lower collar 220. Either or both of the sleeves 222 and 224 may be made of a frictionless material such as Teflon or Delrin. A hinge pin 226 is inserted through the upper sleeve 222 and the lower sleeve 224. The hinge pin 226 includes a cap 228 having a diameter greater than the diameter of the pin 226, the cap 228 resting on rim 223 of the upper sleeve 222 to prevent the pin 226 from falling through the openings defined by the sleeves 222 and 224. The pin assembly 216 permits the door bracket 230 to rotate or pivot relative to the frame bracket 202, thereby allowing the doors 102 and 104 to move between open and closed positions.

Figure 7:
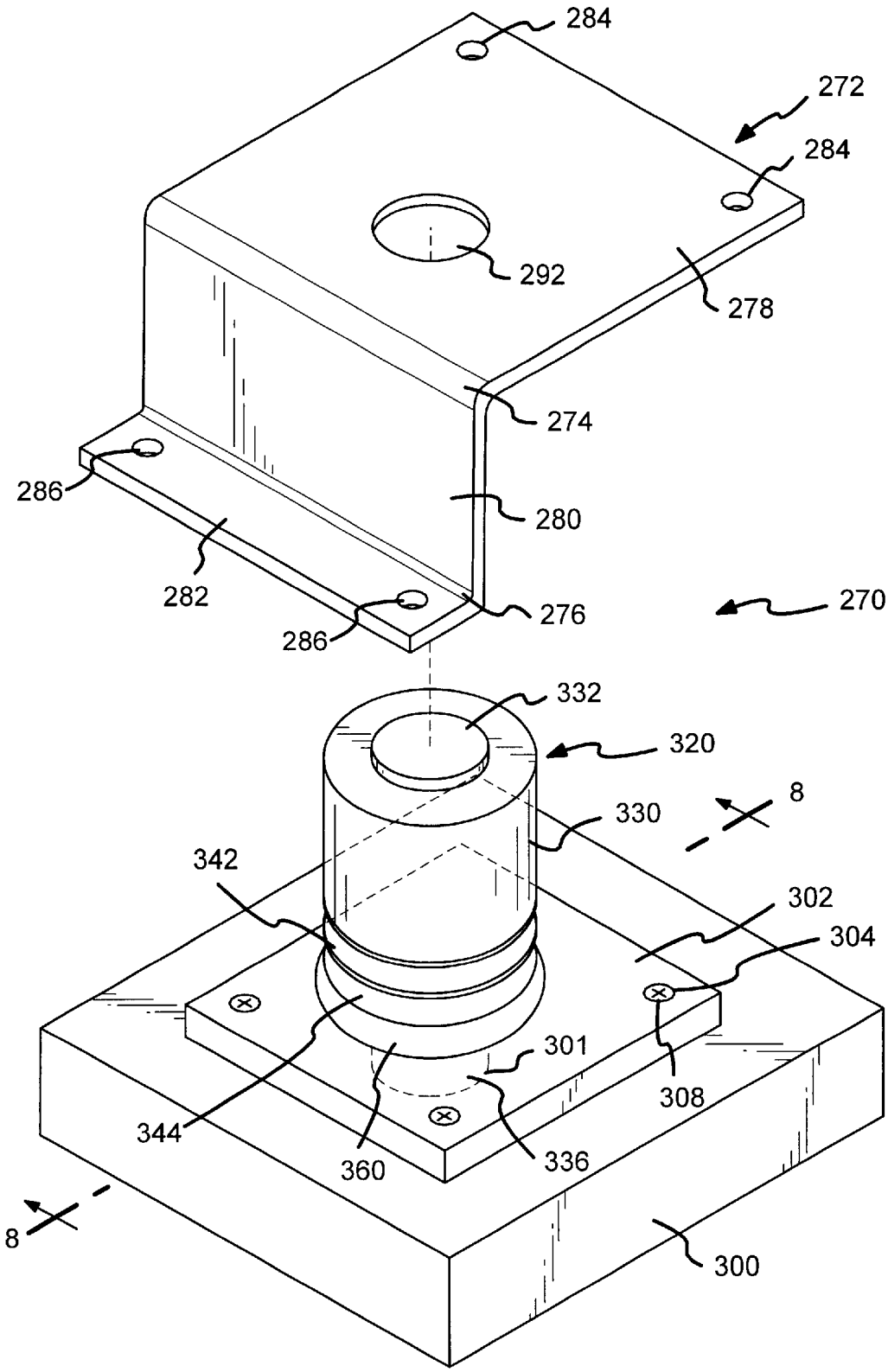
FIG. 7 shows an exploded perspective view of an upper hinge assembly that supports the closet doors shown in FIG. 1.
Figure 8:
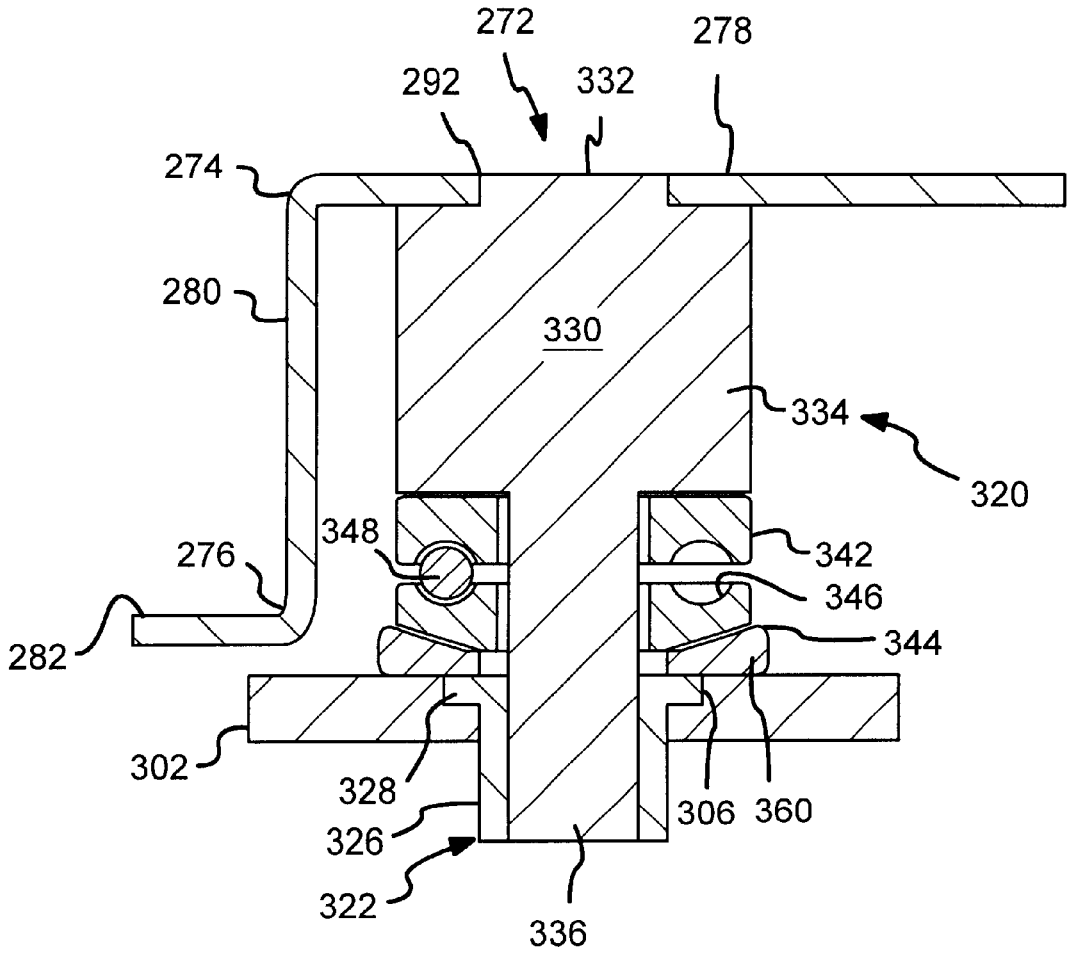
FIG. 8 is a section view through lines 8—8 of FIG. 7.

As best seen in FIGS. 7 and 8, the lower hinge assembly 270 preferably includes a lower door bracket 272, a floor block 300, a support plate 302, and a pin assembly 320. The door bracket 272 is made from a single piece of metal having two bends 274 and 276 forming a elongated upper portion 278, a vertical middle portion 280, and a short lower portion 282. The elongated upper portion 278 has two mounting apertures 284 opposite the first bend 274. The lower portion 282 also includes two mounting apertures 286. The door bracket 272 is mounted to the doors 102 and 104 as shown in FIG. 4. The lower portion 282 is mounted via screws 288 through mounting apertures 286 to a lower edge of the outer side panel 108, while the middle portion 280 rests along an inner surface of the outer side panel 108. The elongated upper portion 278 is mounted via screws 290 through the mounting apertures 284 to a lower surface of the bottom panel 114. A pin aperture 292 is located generally in the center of the elongated upper portion 278 of the lower door bracket 272 as is shown in FIG. 7.

The support plate 302 preferably comprises a square with four mounting apertures 304 located in each of its four corners. Additionally, the support plate 302 has a pin aperture 306 located in its center. The support plate may be mounted to a block 300 via screws 308 through mounting apertures 304. Alternatively the support plate 302 may be mounted directly to the floor. The pin aperture 306 is stepped such that a diameter at its upper surface is larger than a lower diameter adjacent to the block 300. The block 300 includes a cylindrical bore 301 positioned generally in its center. The block 300 may be mounted to the floor of the doorway by any conventional means. For example, the screws 308, if of sufficient length, may be used to mount the block 300 to floor as well as to mount the support plate 302 to the block 300. Alternatively, the weight of the closet doors 102 and 104 may be utilized to secure the lower hinge assembly 270 and block 300 to the floor.

The pin assembly 320 preferably includes a lower pin sleeve 322, a hinge pin 330, a ball bearing assembly 340, and a ball bearing support 360. The lower pin sleeve 322 includes a cylindrical wall 326 and an upper rim 328 and fits within the cylindrical bore 301 of the block 300 so that the rim 328 fits flush within the stepped pin aperture 306 as shown in FIG. 8. The hinge pin 330 includes a cylindrical body portion 334 having a reduced diameter cap 332 extending above the body portion 334 and a reduced diameter pin portion 336 extending below the body portion 334. The cap 332 is sized to fit snugly within the pin aperture 292 of the door bracket 272.

The ball bearing assembly 340 includes an upper race 342 and a lower race 344 forming a ring-shaped channel 346 therebetween. A number of high strength ball bearings 348 are positioned within the channel 346 to permit rotation of the upper race 342 as compared to the lower race 344. The upper race 342 is positioned adjacent to the body portion 334 of the hinge pin 330. A ring-shaped bearing support 360 includes a cammed surface that is positioned between the lower race 344 and the support plate 302 to maintain the lower race 344 centered about the axis of rotation of the hinge pin 330. The ball bearing assembly 340 supports substantially the full weight of the doors 102 and 104. The pin portion 336 of the hinge pin 330 extends through a central opening in the ball bearing assembly 340 and the bearing support 360 so that an outer surface of the pin portion 336 is supported by an inner surface of the sleeve 322. The pin assembly thus allows the lower door bracket 272 to rotate or pivot relative to the support plate 302 to permit the doors 102 and 104 to move between open and closed positions.

Figure 9:
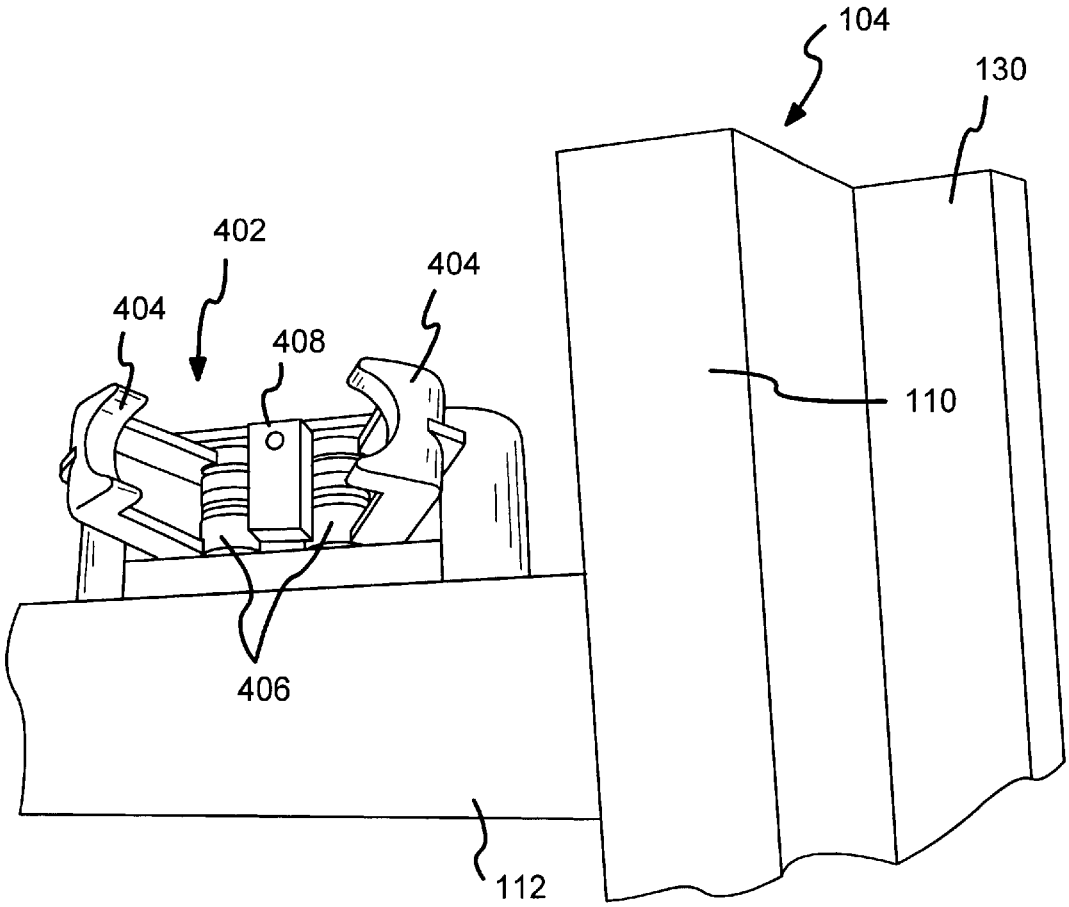
FIG. 9 shows a perspective view of a latch assembly for securing the closet doors shown in FIG. 1.

As best seen in FIGS. 3 and 9, the latch assembly 400 includes a spring latch 402 attached to an interior surface of the door 104, such as the upper surface of the top panel 112 or an inner edge of the top panel 112, and a latch bracket 420 attached to the center of the top of the doorway. Alternatively, the latch bracket 420 may be attached to the top frame 150. The latch bracket 420 preferably includes an activation means, such as a ball 422. As shown in FIG. 9, the spring latch 402 is attached to an interior surface of the door 104, such as the upper surface of the top panel 112 near the inner side panel 110 of the door 104 or an inner edge of the top panel 112. By attaching the latch assembly 400 to an interior of the closet doors 102 and 104, the latch assembly cannot be seen when the closet doors 102 and 104 are in a closed position, thereby helping to conceal the closet doorway.

The spring latch 402 has one or more latch arms 404 with a contact surface 408 positioned therebetween. The latch arms 404 are biased by a spring mechanism 406. The ball 422 of the latch bracket 420 contacts the surface 408 to move the arms 404 between an open and closed position. As the open door 104 is pivoted towards a closed position, the latch 402 approaches the latch bracket 420 until the ball 422 makes contact with the contact surface 408 of the latch 402. This contact activates the latch arms 404 to close around the ball 422 to keep the door 104 in a closed position. The central molding 130 of the door 104 keeps the door 102 in a closed position as well. When pressure is applied to the front of closed door 104, the latch arms 404 disengage the ball 422 thereby allowing the door 104, and thus the door 102, to open. In this way, the doors 102 and 104 do not need a conventional doorknob and thus further help to conceal the closet doorway. Alternatively, any conventional latch mechanism may be used to secure the doors 102 and 104 in a closed position. For example, each of the doors 102 and 104 may have a standard latch mechanism thereby allowing one of the doors to be secured while the other door remains open.

FIG. 2 shows the closet door assembly 100 with the door 104 in an open position. Accessories, such as a mirror 500, may be attached to the interior surface of the back panel 106. Other accessories include a shoe rack, tie rack, belt rack or the like.

Figure 10:
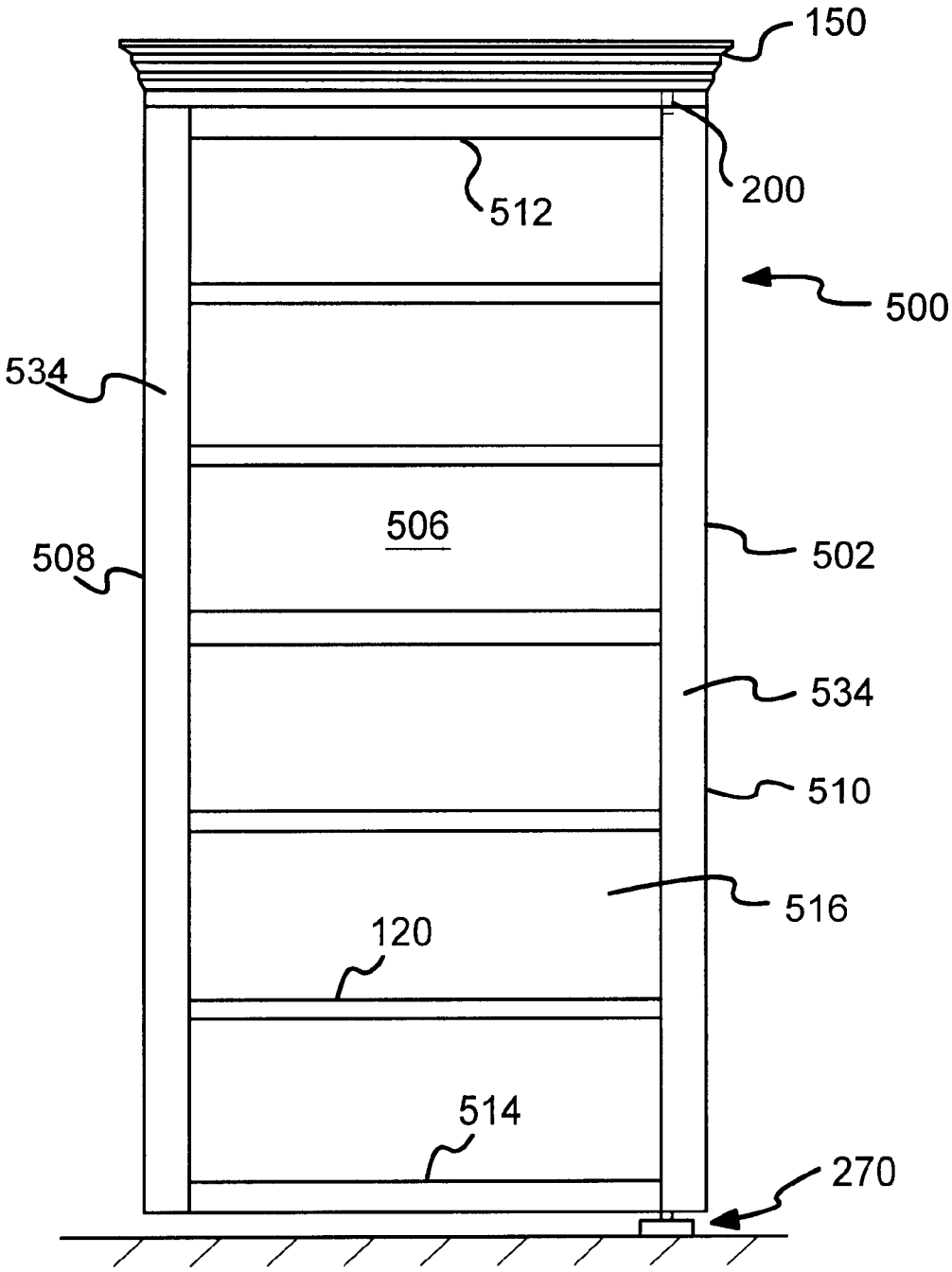
FIG. 10 shows a front plan view of another preferred embodiment of the present invention with a single closet door in a closed position.
Figure 11:
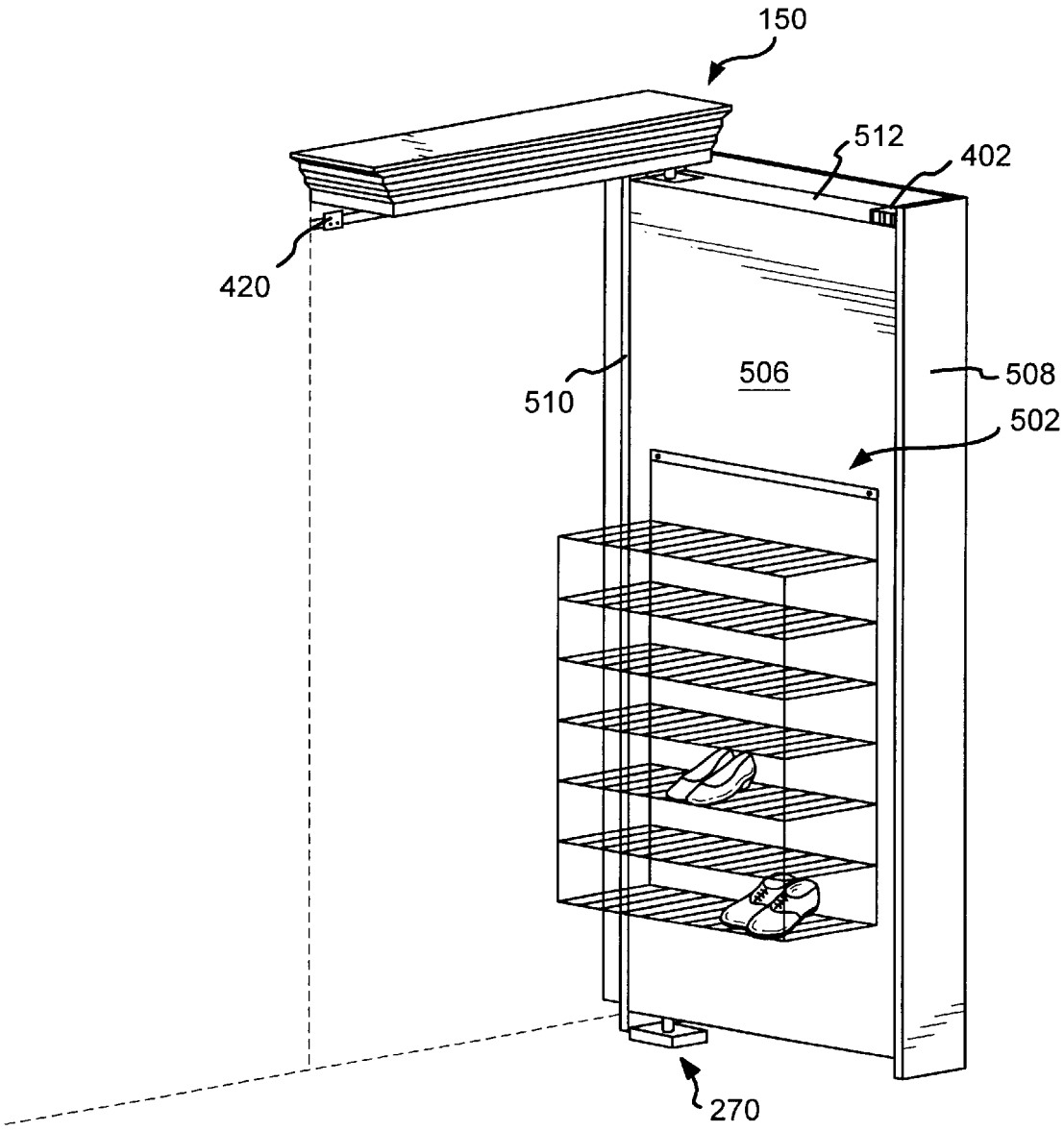
FIG. 11 shows a front plan view of the closet door from FIG. 10 with the closet door in an open position.

FIGS. 10 and 11 show closet door assembly 500, another preferred embodiment of the present invention having a single door 502 for smaller doorways. Similar to the doors 102 and 104, the door 502 has a back panel 506, an inner side panel 508, an outer side panel 510, a top panel 512, and a bottom panel 514. One or more of the shelves 120 are attached within an interior 516 of the door 502. The door 502 may include pieces of vertical molding 534 attached along a front edge 532 of the side panels 510 and 512.

The closet door assembly 500 may include the top frame 150 attached to the top of a doorway as shown in FIGS. 8 and 9. The closet door 500 assembly may additionally include side frames 580 attached to outer side edges 582 of the doorway. The side frames 580 help conceal the doorway and may also provide an outer stop for the door 502 when open.

The door 502 pivots about the upper hinge assembly 200 and the lower hinge assembly 270, and is opened and closed via the latch assembly 400. However, while the closet door assembly 100 has two upper hinge assemblies 200 and two lower hinge assemblies 270, the closet door assembly 500 has only a single upper hinge assembly 200 and a single lower hinge assembly 270; the hinge assemblies may be attached to either the inner side panel 508 or the outer side panel 510.

As shown in FIG. 11, accessories such as shoe rack 502 can be attached to the interior surface of the back panel 506. Other accessories might include, a mirror, tie rack, belt rack, etc.

It will be clear that the present invention is well adapted to attain the ends and advantages mentioned as well as those inherent therein. While presently preferred embodiments have been described for purposes of this disclosure, numerous changes may be made which will readily suggest themselves to those skilled in the art. For example, alternative hinge assemblies may be used provided that the doors 102, 104, and 502 are still positioned flush against the wall to provide the illusion that there is a solid wall behind the shelves. Accordingly, all such modifications, changes and alternatives are encompassed in the spirit of the invention disclosed and as defined in the appended claims.

What is claimed is:

1. A closet door assembly comprising:

first and second closet doors, each closet door having a back panel, an outer side panel, an inner side panel, a top panel, and a bottom panel connected to the back panel forming an interior space;

at least on shelf positioned within the interior space of each closet door;

a top frame attached to a top of a closet doorway, wherein the top frame extends along an entire length of the doorway;

first and second upper hinge assemblies, wherein the first upper hinge assembly pivotally connects at least one of the top panel and the outer side panel of the first closet door to the top frame and the second upper hinge assembly pivotally connects at least one of the top panel and the outer side panel of the second closet door to the top frame; and first and second lower hinge assemblies, wherein the first lower hinge assembly pivotally connects at least one of the bottom panel and the outer side panel of the first closet door to a floor surface of the closet doorway and the second lower hinge assembly pivotally connects at least one of the bottom panel and the outer side panel of the second closet door to the floor surface, and wherein the hinge assemblies permit the inner side panel of each of the closet doors to pivot away from an open position, away from the doorway, to a closed position covering the doorway where the inner side panels of the closet doors are adjoined and the closet doors together extend along the entire length of the doorway to substantially conceal the closet doorway; and wherein the first and second upper hinge assemblies each comprise a frame bracket attached to the top frame, an upper door bracket attached to one of the first and second closet doors, and a pin assembly pivotally connecting the frame bracket to the upper door bracket, wherein the frame bracket has a front wall mounted to an inner surface of a front panel of the top frame and a base including a pin aperture positioned opposite of the front wall for receiving a pin of the pin assembly, the upper door bracket including a metal sheet having a horizontal bottom portion, a vertical middle portion, and a horizontal top portion, wherein the horizontal bottom portion is mounted to the top panel and the horizontal top portion is mounted to an upper edge of the outer side panel of one of said first and second closet doors such that the vertical middle portion rests along an inner surface of the outer side panel of said door, and wherein the horizontal bottom portion includes a pin aperture for receiving a pin from the pin assembly.

2. The closet door assembly of claim 1 wherein the pin assembly comprises:

an upper collar fixed about the pin aperture formed in the frame bracket;

a lower collar fixed about the pin aperture formed in the door bracket;

an upper sleeve having a rim that fits within the upper collar such that the rim rests on an upper surface of the base of the frame bracket;

a lower sleeve that fits within the lower collar; and a hinge pin inserted through the upper sleeve and the lower sleeve, wherein the hinge pin includes a cap with a diameter greater than the diameter of the pin such that the cap rests on the rim of the upper sleeve.

3. The closet door assembly of claim 2 wherein the door bracket pivots about the hinge pin relative to the frame bracket.

4. The closet door assembly of claim 3 wherein at least one of the upper sleeve or the lower sleeve is composed of frictionless material.

5. A closet door assembly comprising:

a closet door having a back panel, an outer side panel, an inner side panel, a top panel, and a bottom panel connected to the back panel forming an interior space;

at least one shelf positioned within the interior space of the closet door;

a top frame attached to a top of a closet doorway, wherein the top frame extends along an entire length of the doorway;

an upper hinge assembly pivotally connecting at least one of the top panel and the outer side panel of the closet door to the top frame; and a lower hinge assembly pivotally connecting at least one of the bottom panel and the outer side panel of the closet door to a floor surface of the closet doorway, wherein the upper and lower hinge assemblies allow the closet door to pivot between an open position away from the doorway and a closed position covering the doorway where the back panel of the closet door extends along the entire length of the doorway to substantially conceal the closet doorway; and wherein the upper hinge assembly includes a frame bracket attached to the top frame, an upper door bracket attached to the closet door, and a pin assembly pivotally connecting the frame bracket to the upper door bracket, wherein the frame bracket comprises a front wall mounted to an inner surface of a front panel of the top frame and a base including a pin aperture positioned opposite the front wall for receiving a pin of the pin assembly, and wherein the upper door bracket comprises a metal sheet having a horizontal bottom portion, a vertical middle portion, and a horizontal top portion, wherein the horizontal bottom portion is mounted to the top panel of the door and the horizontal top portion is mounted to an upper edge of the outer side panel such that the vertical middle portion rests along an inner surface of the outer side panel, and wherein the horizontal bottom portion includes a pin aperture for receiving a pin from the pin assembly.

6. The closet door assembly of claim 5 wherein the pin assembly comprises:

an upper collar fixed about the pin aperture formed in the frame bracket, a lower collar fixed about the pin aperture formed in the door bracket;

an upper sleeve having a rim that fits within the upper collar such that the rim rests on an upper surface of the base of the frame bracket;

a lower sleeve that fits within the lower collar; and a hinge pin inserted through the upper sleeve and the lower sleeve, wherein the hinge pin includes a cap with a diameter greater than the diameter of the pin such that the cap rests on the rim of the upper sleeve.

7. The closet door assembly of claim 6 wherein the door bracket pivots about the hinge pin relative to the frame bracket.

8. The closet door assembly of claim 7 wherein at least one of the upper sleeve or the lower sleeve is composed of frictionless material.

9. A closet door assembly comprising:

a closet door having a back panel, an outer side panel, an inner side panel a top panel, and a bottom panel connected to the back panel forming an interior space;

at least one shelf positioned within the interior space of the closet door;

a top frame attached to a top of a closet doorway, wherein the top frame extends along an entire length of the doorway;

an upper hinge assembly pivotally connecting at least one of the top panel and the outer side panel of the closet door to the top frame; and a lower hinge assembly pivotally connecting at least one of the bottom panel and the outer side panel of the closet door to a floor surface of the closet doorway, wherein the upper and lower hinge assemblies allow the closet door to pivot between an open position away from the doorway and a closed position covering the doorway where the back panel of the closet door extends along the entire length of the doorway to substantially conceal the closet doorway; and wherein the lower hinge assembly further comprises a lower door bracket, a support plate near a floor surface of the closet doorway, and a pin assembly pivotally connecting the lower door bracket to the support plate wherein the lower door bracket comprises a metal sheet having a horizontal upper portion, a vertical middle portion, and a horizontal lower portion, wherein the horizontal lower portion is mounted to a lower edge of the outer side panel and the elongated upper portion is mounted to a lower surface of the bottom panel of the door such that the middle portion rests along an inner surface of the outer side panel, and wherein the horizontal upper portion includes a pin aperture for receiving a pin from the pin assembly.

10. The closet door assembly of claim 9 wherein the support plate includes a pin aperture formed in its center.

11. The closet door assembly of claim 10 wherein the support plate is mounted to a floor block positioned on the floor surface of the closet doorway.

12. The closet door assembly of claim 11 wherein the floor block is fixed to the floor surface of the closet doorway.

13. The closet door assembly of claim 11 where the pin assembly comprises:

a lower pin sleeve fitting within the pin aperture of the support plate and extending within a cylindrical bore formed in the floor block;

a ball bearing assembly defining a central opening; and a hinge pin inserted through the pin aperture of the lower door bracket, the central opening of the ball bearing assembly, and the lower pin sleeve.

14. The closet door assembly of claim 13 wherein the hinge pin comprises a cylindrical body portion having a reduced diameter cap extending above the body portion and a reduced diameter pin portion extending below the body portion, wherein the cap fits snugly within the pin aperture of the door bracket and the pin portion extends through both the central opening of the ball bearing assembly and the lower pin sleeve, and wherein a bottom surface of the cylindrical body portion rests atop the ball bearing assembly.

15. A closet door assembly comprising:

first and second closet doors, each closet door having a back panel, an outer side panel, an inner side panel, a top panel, and a bottom panel connected to the back panel forming an interior space;

at least one shelf positioned within the interior space of each closet door;

a top frame attached to a top of a closet doorway, wherein the top frame extends along an entire length of the doorway;

first and second upper hinge assemblies, wherein the first upper hinge assembly pivotally connects at least one of the top panel and the outer side panel of the first closet door to the top frame and the second upper hinge assembly pivotally connects at least one of the top panel and the outer side panel of the second closet door to the top and first and second lower hinge assemblies, wherein the first lower hinge assembly pivotally connects at least one of the bottom panel and the outer side panel of the first closet door to a floor surface of the closet doorway and the second lower hinge assembly pivotally connects at least one of the bottom panel and the outer side panel of the second closet door to the floor surface, and wherein the hinge assemblies permit the inner side panel of each of the closet doors to pivot away from an open position, away from the doorway, to a closed position covering the doorway where the inner side panels of the closet doors are adjoined and the closet doors together extend along the entire length of the doorway to substantially conceal the closet doorway; and wherein the first and second lower hinge assemblies each comprise a lower door bracket, a support plate near a floor surface of the closet doorway, and a pin assembly pivotally connecting the lower door bracket to the support plate, wherein the lower door bracket comprises a metal sheet having a horizontal upper portion, a vertical middle portion, and a horizontal lower portion, wherein the horizontal lower portion is mounted to a lower edge of the outer side panel and the elongated upper portion is mounted to a lower surface of the bottom panel of one of the first and second closet doors such that the middle portion rests along an inner surface of the outer side panel, and wherein the horizontal upper portion includes a pin aperture for receiving a pin from the pin assembly.

16. The closet door assembly of claim 15 wherein the support plate includes a pin aperture formed in its center.

17. The closet door assembly of claim 16 wherein the support plate is mounted to a floor block positioned on the floor surface of the closet doorway.

18. The closet door assembly of claim 17 wherein the floor block is fixed to the floor surface of the closet doorway.

* * * * *